US008123312B2

(12) United States Patent
Jeon et al.

(10) Patent No.: US 8,123,312 B2
(45) Date of Patent: Feb. 28, 2012

(54) DOOR ASSEMBLY

(75) Inventors: Yong Min Jeon, Changwon-si (KR); Han Ki Cho, Changwon-si (KR); Chang Woo Son, Changwon-si (KR)

(73) Assignee: LG Electronics Inc., Seoul (KR)

( * ) Notice: Subject to any disclaimer, the term of this patent is extended or adjusted under 35 U.S.C. 154(b) by 542 days.

(21) Appl. No.: 12/320,073

(22) Filed: Jan. 15, 2009

(65) Prior Publication Data

US 2009/0251032 A1 Oct. 8, 2009

(30) Foreign Application Priority Data

Jan. 17, 2008 (KR) ..... 10-2008-0005260

(51) Int. Cl.
*A47B 77/06* (2006.01)

(52) U.S. Cl. .. 312/228; 312/222; 292/121; 292/DIG. 69

(58) Field of Classification Search ..... 312/215, 312/222, 228; 68/12.26, 196; 292/95, DIG. 69, 292/121, 116, 117, 128
See application file for complete search history.

(56) References Cited

U.S. PATENT DOCUMENTS 6,634,684 B2 * 10/2003 Spiessl ..... 292/341.16
7,269,981 B2 * 9/2007 Kwon ..... 68/3 R
7,427,086 B2 * 9/2008 Park et al. ..... 292/95
7,644,963 B2 * 1/2010 Fan et al. ..... 292/95
7,654,590 B2 * 2/2010 Hapke ..... 292/251.5
7,677,064 B2 * 3/2010 Kim et al. ..... 68/196
7,775,070 B2 * 8/2010 Lim et al. ..... 68/12.26
2004/0104582 A1 * 6/2004 Hwang ..... 292/121
2004/0244435 A1 * 12/2004 Kim ..... 68/12.26
2008/0100066 A1 * 5/2008 Mueller et al. ..... 292/24
2009/0096222 A1 * 4/2009 Sans Rovira et al. ..... 292/216
2009/0251032 A1 * 10/2009 Jeon et al. ..... 312/220
2010/0283362 A1 * 11/2010 Choi ..... 312/228
2010/0314889 A1 * 12/2010 Wang et al. ..... 292/97
2011/0025178 A1 * 2/2011 Schone ..... 312/228

* cited by examiner

*Primary Examiner* — Janet M Wilkens
*Assistant Examiner* — Daniel Rohrhoff
(74) *Attorney, Agent, or Firm* — McKenna Long & Aldridge LLP

(57) ABSTRACT

A door assembly includes a hook hole, a door having a hook shaft to be placed in the hook hole, and a holder between the hook hole and the hook shaft for maintaining the door to be in a state the door is opened by a predetermined gap, wherein the holder includes a first holder to be engaged with the door and a second holder to be engaged with hook hole, wherein the second holder includes a hook member for placing in, and holding the hook hole. The assembly, for example, prevents a tub of a washing machine from being enclosed when the washing machine is not in operation.

7 Claims, 4 Drawing Sheets

DOOR ASSEMBLY

This application claims the benefit of the Patent Korean Application No. 10-2008-0005260, filed on Jan. 17, 2008, which is hereby incorporated by reference as if fully set forth herein.

BACKGROUND OF THE INVENTION

1. Field of the Invention

The present invention relates to washing machines, and more particularly, to a door assembly for a washing machine which prevents a tub from being enclosed when the washing machine is not in operation.

2. Discussion of the Related Art

A drum type washing machine is a home appliance for washing laundry by using friction between the laundry and a drum rotating by driving force from a motor in a state detergent, washing water and the laundry are introduced to the drum. The drum type washing machine is advantageous in that almost no laundry damage takes place, and the laundry does not entangle.

In the meantime, the drum type washing machine is provided with a tub which is a water holding tank mounted in a cabinet, and the drum rotatably mounted in the tub. The drum type washing machine is also provided with a door mounted to the cabinet for introduction/taking out laundry to/from the drum.

Since the detergent, the washing water, and the laundry escapes from the drum and makes surroundings unclean if the door is opened in the middle of washing, the door is required to be maintained in a fastened state to the cabinet. Accordingly, the door has a hook assembly at one side, and the cabinet has a door lock for fastening the hook assembly thereto.

Therefore, for using the washing machine, the user opens the door, introduces the laundry to the drum, closes the door, and carries out the washing. Then, after the washing is finished, the user opens the door, takes the laundry out of the drum, and dries the laundry.

In the meantime, in many cases, the user maintains the door in a closed state after the washing is finished. If the door is left closed even when the drum type washing machine is not in use, harmful fungi or the like are likely to grow in the tub by water remained in the tub.

SUMMARY OF THE INVENTION

Accordingly, the present invention is directed to a door assembly for a washing machine that substantially obviates one or more problems due to limitations and disadvantages of the related art.

An object of the present invention is to provide a door assembly for a washing machine, which is maintained in an opened state when the washing machine is not in use for preventing harmful fungi and the like from growing in a tub.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a door assembly includes a hook hole for maintaining a closed state of a door, a door having a hook shaft to be placed in the hook hole, and a holder between the hook hole and the hook shaft for maintaining the door to be in a state the door is opened by a predetermined gap.

The holder includes a first holder to be engaged with the door, and a second holder to be engaged with the hook hole.

The first holder includes a hook recess for placing the hook shaft therein for holding the door.

The second holder includes a hook member for placing in, and holding the hook hole.

The hook member has a shape the same with the hook shaft.

In another aspect of the present invention, a door assembly for a washing machine includes a cabinet having a hook hole for maintaining a closed state of a door, a tub mounted in the cabinet, a door having a hook shaft to be placed in the hook hole for opening/closing the tub, and a holder between the door and the cabinet for making a predetermined space between the door and the cabinet when the door is closed.

The holder includes a first holder to be engaged with the door, and a second holder to be engaged with the cabinet.

The first holder includes a hook recess for placing in, and holding the hook shaft.

The second holder includes a hook member for placing in, and holding the hook hole.

The hook member has a shape the same with the hook shaft.

The cabinet is formed of a magnetic material, and the second holder includes a magnetic member for holding the cabinet with magnetic force.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
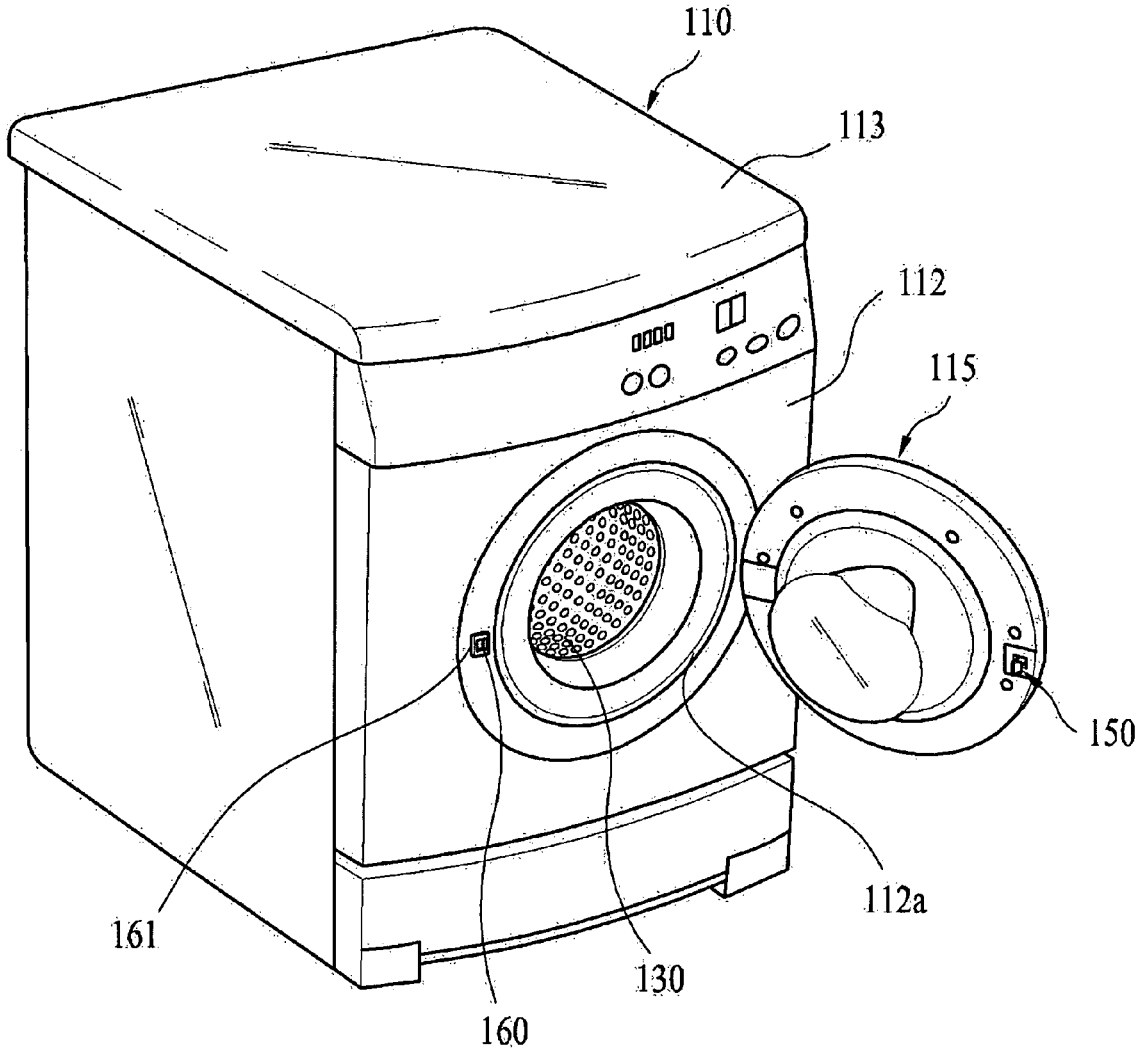
FIG. 1 illustrates a perspective view of a washing machine having a door assembly of the present invention applied thereto.
Figure 2:
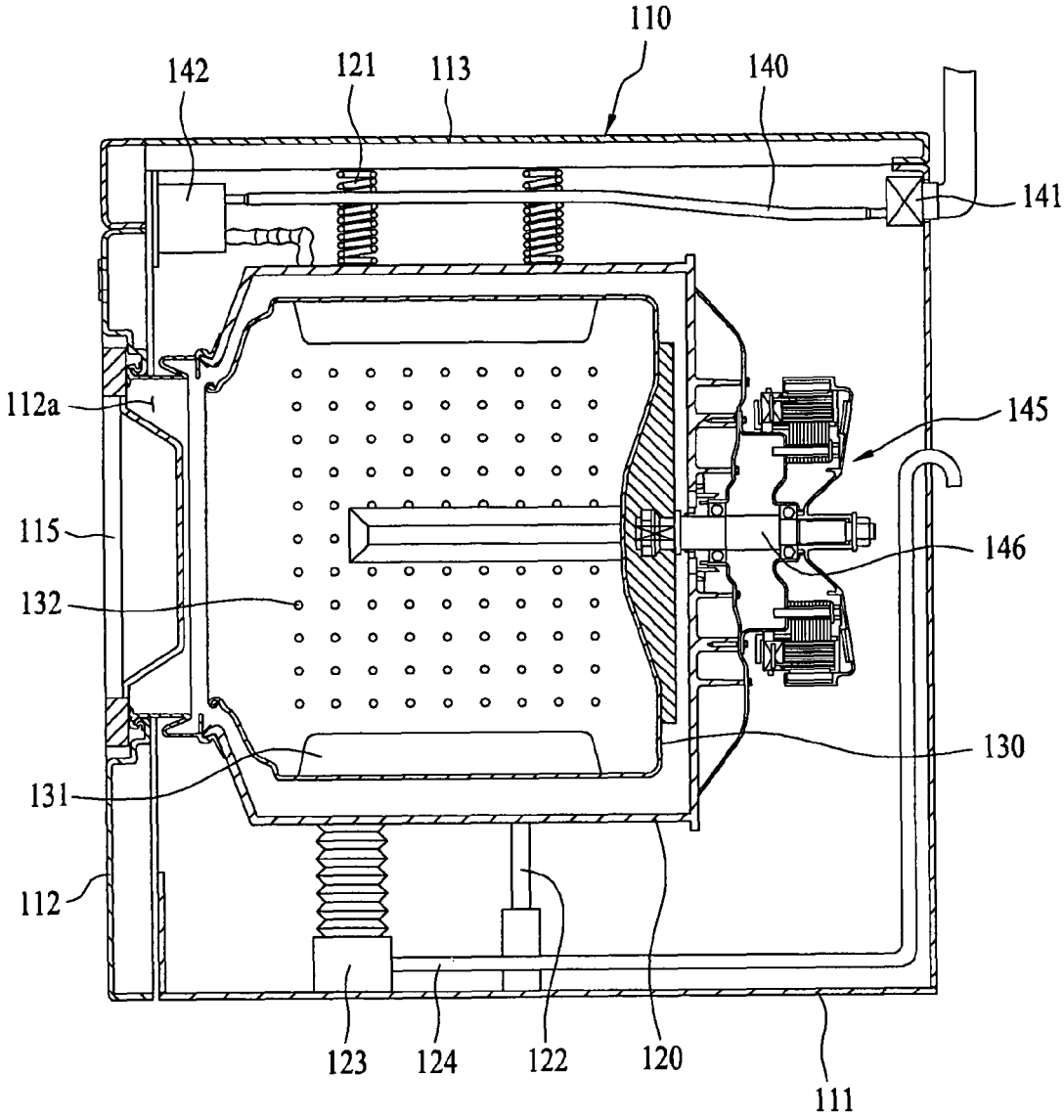
FIG. 2 illustrates a section of the washing machine in FIG. 1.

FIG. 1 illustrates a perspective view of a washing machine having a door assembly of the present invention applied thereto, and FIG. 2 illustrates a section of the washing machine in FIG. 1.

Referring to FIGS. 1 and 2, the a washing machine having a door assembly of the present invention applied thereto includes a cabinet 110 which forms an exterior of the washing machine, a tub 120 mounted in the cabinet 110 for holding washing water, a drum 130 rotatably mounted in the tub 120, and a motor 145 for rotating the drum 130.

The cabinet 110 has a body 111 which forms sides, a rear, and a bottom thereof, a front plate 112 which forms a front thereof, and a top plate 113 which is fastened to a top of the body 111 to form a top of the body 111.

The front plate 112, a front of the cabinet 110, has a laundry opening 112*a* for introduction of the laundry, closable with a door 115 rotatably mounted to the cabinet 110.

Referring to FIG. 2, the tub 120 is suspended from the cabinet 110 with springs 121, and supported on a friction damper 122 fixed to a bottom of the cabinet, such that vibration from the drum 130 caused by high speed rotation is attenuated.

The drum 130 has lifters 131 on an inside surface for lifting the laundry in the drum 130 to a predetermined height. The drum has a plurality of pass through holes 132 in an inside surface for enabling the washing water to escape from the drum 130 in a washing course, such as spinning.

Mounted on an upper side of the tub 120, there are a water supply hose 140 for supplying the washing water to the tub 120 from an external water supply source, a water supply valve 141 mounted to the water supply hose 140 for controlling inlet/outlet of the washing water, and a detergent supply device 142 having detergent stored therein for introduction of the washing water being supplied through the water supply hose 140 to the tub 120 together with the detergent.

Under the tub 120, there may be a drain hose (124) and a drain pump (not shown) for draining the washing water used in the washing and rinsing to an outside of the washing machine.

The motor 145 is mounted in rear of the tub 120, and fixed to the drum 130 through a rotating shaft 146, for rotating the drum 130.

In the meantime, if the door 115 opens in the middle of the washing course, it is liable that the detergent, the washing water, and the laundry escapes from the drum and makes surroundings unclean. In order to prevent this from taking place, the door 115 has a hook assembly 150 at one side, and the cabinet 110 has a door lock 160 with a hook hole 161 for holding the hook assembly 150.

However, if a mode of use of the drum type washing machine having above system is reviewed, the user opens the door, introduces the laundry to the drum, closes the door, and carries out washing. Then, after the washing is finished, the user opens the door, takes the laundry out of the drum, and dries the laundry. However, in a case the user maintains the door in a closed state after finish of the washing, harmful fungi or the like are likely to grow in the tub by water remained in the tub, and if the door is left open, the door is liable to sag by gravity.

A door assembly of the present invention which can solve above problem will be described.

Figure 3:
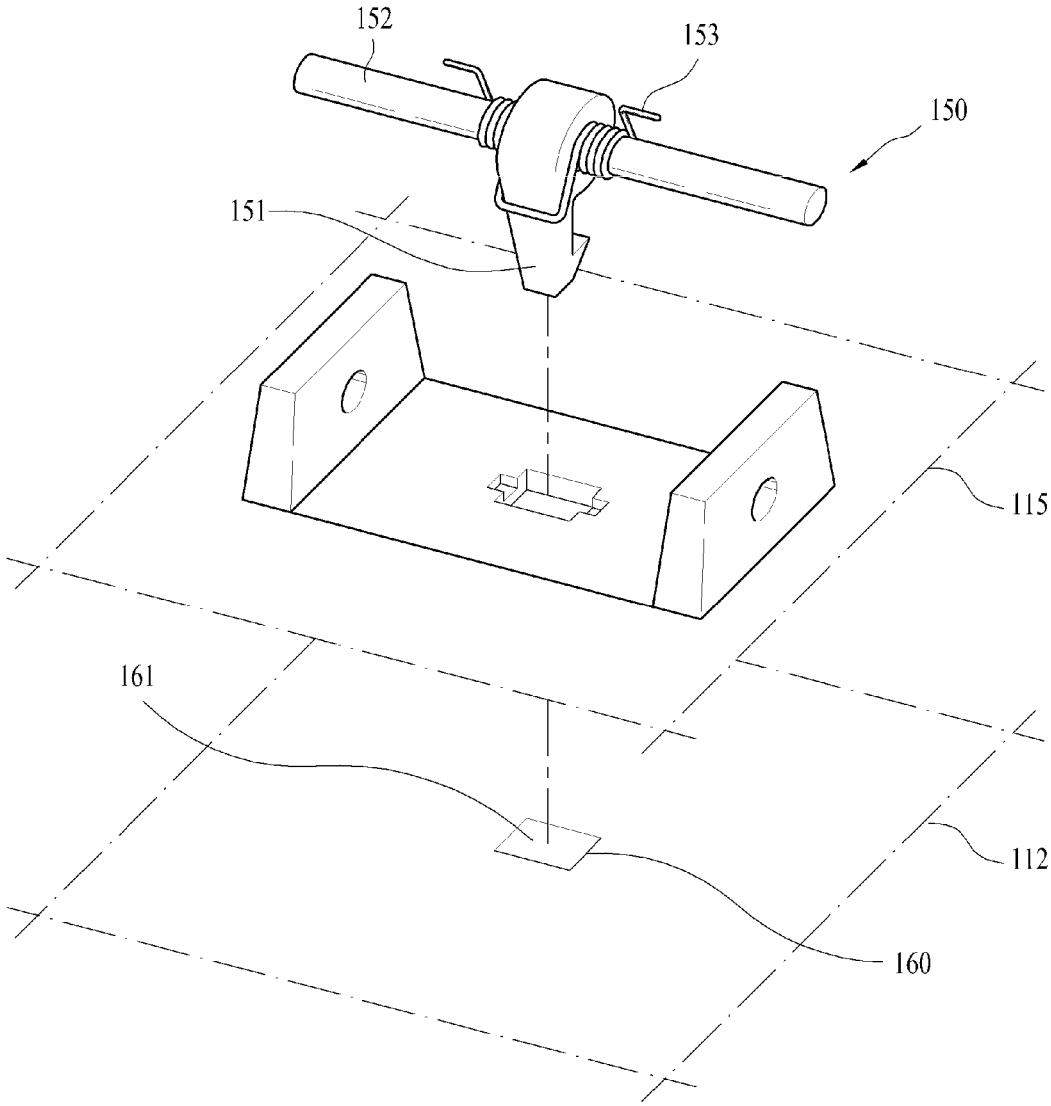
FIG. 3 illustrates an exploded perspective view of a hook assembly applied to the door assembly of the present invention.

FIG. 3 illustrates an exploded perspective view of a hook assembly applied to the door assembly of the present invention.

Referring to FIG. 3, the hook assembly 150 includes a hook shaft 151 for placing in and holding the door lock 160, a rotation shaft 152 rotatably fixed to the door 115 such that the hook shaft 151 can rotate, and an elastic member 153 for supporting the hook shaft 151 elastically such that the hook shaft 151 snaps with the door lock 160.

Accordingly, if the user closes the door 115, since the hook shaft 151 of the hook assembly 150 is placed in and holds the hook hole 161, the door 115 can maintain a state in which the laundry opening 112*a* in the front plate 112 is closed.

Figure 4:
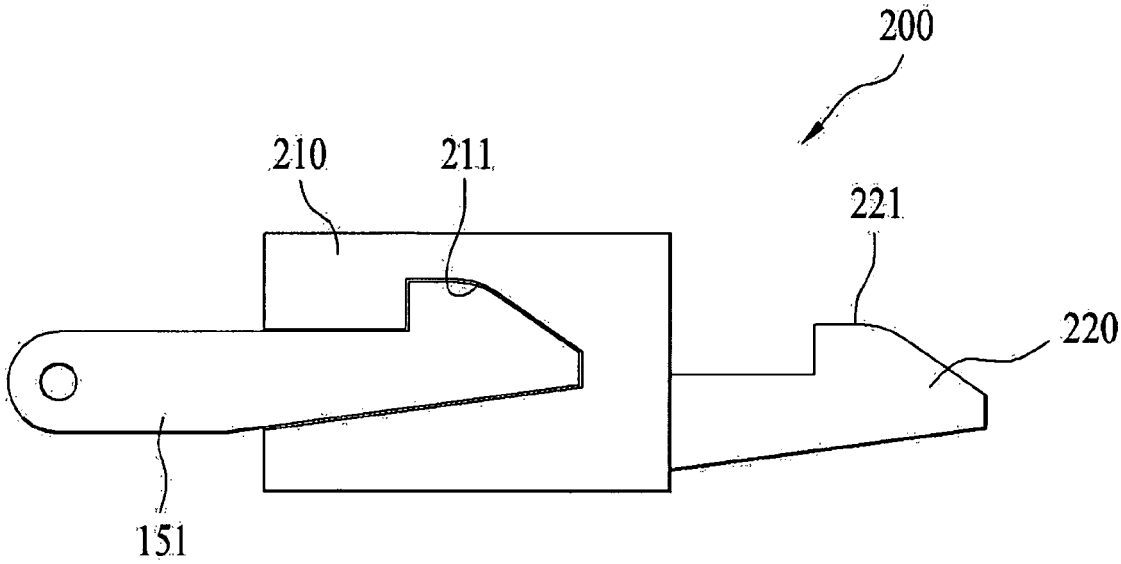
FIG. 4 illustrates a diagram showing a holder in a door assembly in accordance with a preferred embodiment of the present invention.

FIG. 4 illustrates a diagram showing a holder in a door assembly in accordance with a preferred embodiment of the present invention.

Referring to FIG. 4, the holder 200 in the door assembly is devised to be placed between the door 115 and the cabinet 110 for maintaining a predetermined gap between the door 115 and the cabinet 110.

In order to make the holder 200 to be placed between the door 115 and the cabinet 110, the holder 200 includes a first holder 210 for engaging with the door 115 and a second holder 220 for engaging with the cabinet 110.

The first holder 210 has a hook recess 211 for receiving and holding the hook shaft 151. Therefore, as the hook shaft 151 is placed in the hook recess 211, the holder 200 holds the hook shaft 151.

The second holder 220 has a hook member 221 with a shape the same with the hook shaft 151. Therefore, if the user closes the door 115 in a state the holder 200 holds the hook shaft 151, the hook member 221 is placed in the hook hole 161 in the cabinet 110, thereby making the door 115 fastened to the cabinet 110.

In this case, since there is the holder 200 positioned between the door 115 and the cabinet 110, maintaining the door 115 and the cabinet 110 to be spaced a predetermined distance away from each other, ventilation can be made through the gap between the door 115 and the cabinet 110. Eventually, the door assembly for a washing machine of the present invention can prevent foreign matters, such as fungi or the like, from growing in the tub 120. Moreover, even if the door is left open, sagging of the door by gravity can be prevented.

Figure 5:
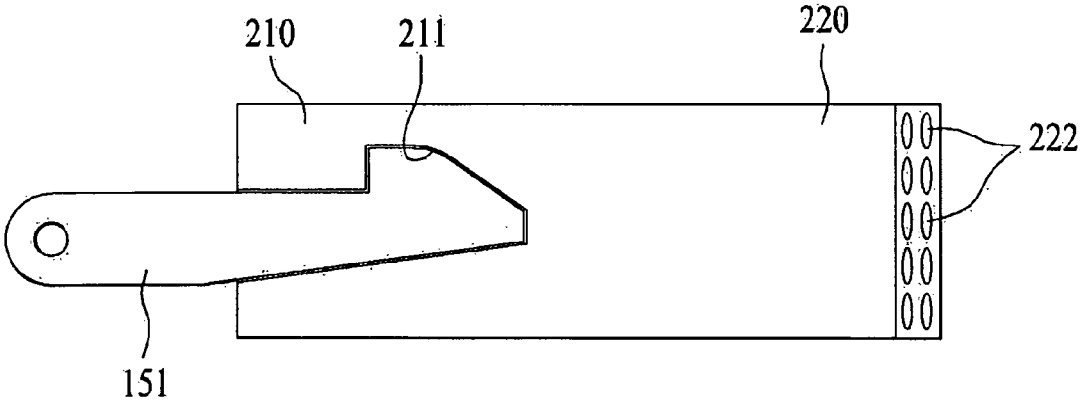
FIG. 5 illustrates a diagram showing a holder in a door assembly in accordance with another preferred embodiment of the present invention.

FIG. 5 illustrates a diagram showing a holder in a door assembly in accordance with another preferred embodiment of the present invention.

Referring to FIG. 5, though the holder 200 of the embodiment is the same with the holder 200 of the foregoing embodiment, the holder 200 of the embodiment is different from the holder 200 of the foregoing embodiment in that the holder 200 of the embodiment includes a second holder 220 having a magnet member 222.

As the hook shaft 151 is placed in the hook recess 211, the holder 200 holds the hook assembly 150. If the user closes the door 115 in a state the holder 200 holds the hook shaft 151, the magnet member 222 holds the cabinet 110 of metal by magnetic force, thereby making the door 115 to be held by the cabinet 110.

Therefore, the door 115 and the cabinet 110 are maintained to be spaced a predetermined distance away from each other. Eventually, ventilation can be made through the gap between the door 115 and the cabinet 110, enabling to prevent the foreign matters, such as fungi or the like, from growing in the tub 120.

As has been described, the door assembly for a washing machine of the present invention has the following advantage.

The holder 200 between the door 115 and the cabinet 200 forms a gap good for ventilation even if the user closes the door 115 to the cabinet 110, thereby permitting to maintain a state in which the door 115 and the cabinet 110 are spaced a predetermined distance away from each other even if the washing machine is not in use, allowing to prevent harmful matters, such as fungi or the like, from growing in the tub 120, as well as offensive odor from generating.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A door assembly comprising:

a hook hole;

a door having a hook shaft to be placed in the hook hole; and a holder between the hook hole and the hook shaft for maintaining the door to be in a state the door is opened by a predetermined gap, wherein the holder includes:

a first holder to be engaged with the door; and a second holder to be engaged with hook hole, wherein the second holder includes a hook member for placing in, and holding the hook hole.

2. The door assembly as claimed in claim 1, wherein the first holder includes a hook recess for placing the hook shaft therein for holding the door.

3. The door assembly as claimed in claim 1, wherein the hook member has a shape the same with the hook shaft.

4. A washing machine comprising:

a cabinet having a hook hole;

a tub mounted in the cabinet;

a door having a hook shaft to be placed in the hook hole for opening/closing the tub; and a holder between the door and the cabinet for making a predetermined space between the door and the cabinet when the door is closed, wherein the holder includes:

a first holder to be engaged with the door; and a second holder to be engaged with the cabinet, wherein the second holder includes a hook member for placing in, and holding the hook hole.

5. The washing machine as claimed in claim 4, wherein the first holder includes a hook recess for placing in, and holding the hook shaft.

6. The washing machine as claimed in claim 4, wherein the hook member has a shape the same with the hook shaft.

7. The washing machine as claimed in claim 4, wherein the cabinet is formed of a magnetic material, and the second holder includes a magnetic member for holding the cabinet with magnetic force.

* * * * *